US006736561B2

(12) United States Patent
Castelli et al.

(10) Patent No.: US 6,736,561 B2
(45) Date of Patent: May 18, 2004

(54) APPARATUS AND METHOD FOR THE PREVENTION OF TRAILING EDGE DELETION IN IMAGE FORMING SYSTEMS

(75) Inventors: Vittorio Castelli, Yorktown Heights, NY (US); Joannes N.M. deJong, Suffern, NY (US); Lloyd A. Williams, Mahopac, NY (US); Harold M. Anderson, Rancho Palo Verdes, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/768,867

(22) Filed: Jan. 24, 2001

(65) Prior Publication Data

US 2002/0098024 A1 Jul. 25, 2002

(51) Int. Cl.[7] ..... B41J 13/10; B41J 2/32
(52) U.S. Cl. ..... 400/645; 400/642
(58) Field of Search ..... 400/642, 643, 400/644, 645, 645.1, 645.3, 645.4, 645.5

(56) References Cited

U.S. PATENT DOCUMENTS 4,668,960 A * 5/1987 Okamura ..... 346/24
4,729,557 A * 3/1988 Kiyohara ..... 271/264
4,849,772 A * 7/1989 Ten Broeck et al. ..... 346/104
5,067,705 A * 11/1991 Van Horne et al. ..... 271/277
5,449,241 A * 9/1995 Matsui et al. ..... 400/314
5,527,123 A 6/1996 Jackson et al.
5,564,847 A 10/1996 Patrick et al.
5,583,629 A 12/1996 Brewington et al. ..... 355/326
5,800,076 A 9/1998 Umeda
6,068,415 A * 5/2000 Smolenski ..... 400/120.16
6,139,140 A 10/2000 Rasmussen et al.

FOREIGN PATENT DOCUMENTS

EP 0 729 842 A2 9/1996
EP 0 729 842 A3 7/1998
JP 03199069 A * 8/1991 ..... B41J/11/20
JP 04144750 A * 5/1992 ..... B41J/2/01
JP 06312550 A * 11/1994 ..... B41J/13/10
JP 11221948 A * 8/1999 ..... B41J/15/04

* cited by examiner

*Primary Examiner*—Daniel J. Colilia
(74) *Attorney, Agent, or Firm*—Fay, Sharpe, Fagan, Minnich & McKee, LLP

(57) ABSTRACT

The present invention provides a capability to form an image along a trailing edge of the paper by the use of a trailing edge deletion prevention apparatus capable of manipulating the paper to allow components capable of forming the image to travel in proximity to the paper without obstruction. In various embodiments, the invention involves the use of a biasing member or an interdigitated support element, each providing a trailing edge deletion prevention capability.

16 Claims, 1 Drawing Sheet

APPARATUS AND METHOD FOR THE PREVENTION OF TRAILING EDGE DELETION IN IMAGE FORMING SYSTEMS

FIELD OF THE INVENTION

The present invention relates generally to the positioning of printing surfaces and printing devices and specifically to the capability of printing on a trailing edge of a piece of paper.

BACKGROUND OF THE INVENTION

Image forming systems involve a variety of internal components configured to manipulate a piece of paper and produce an image on the paper. Conventional image forming systems are unable to produce an image along a trailing edge of the paper due to physical interference between internal components forming a paper path, e.g. manipulating the paper, and components capable of forming the image. Typically, the unprintable portion of the trailing edge may be up to approximately 3 cm, thereby reducing the utility of the image forming system to form an image on the paper.

SUMMARY OF THE INVENTION

The present invention overcomes the limitations of conventional image forming systems as discussed above by the use of a trailing edge deletion prevention apparatus capable of manipulating the paper to allow components capable of forming the image to travel in proximity to the paper without obstruction.

According to a first embodiment of the invention, a trailing edge deletion prevention apparatus suitable for use with an image forming system is provided, having a paper guide mounted along a paper path and adapted to guide the paper along the paper path and a biasing member mounted to the image forming system and biased against the paper guide along the paper path and allowing a printing device to pass proximate to the biasing member while printing along a trailing edge of the paper.

According to a further embodiment of the invention, a trailing edge deletion prevention apparatus suitable for use with an image forming system is provided, having a paper guide mounted along a paper path and adapted to guide the paper along the paper path and a biasing member mounted to the image forming system and biased against the paper guide to cause the paper to be taut to a location further along the paper path and configured to accommodate a printing device to access a trailing edge of the paper.

According to a first embodiment of the invention, a trailing edge deletion prevention apparatus suitable for use with an image forming system is provided, having an interdigitated support element forming a plane and having a first portion interdigitated with a second portion, wherein the first portion and the second portion are movable relative to each other within the plane, an attachment device to secure a piece of paper to at least one of the first portion and the second portion, wherein the attachment device is adapted to selectively secure the paper to one of the first portion and the second portion to allow the paper to be advanced along the plane by the relative movement of the first portion and the second portion.

According to a first embodiment of the invention, a method for deleting a trailing edge of a piece of paper processed by an image forming system is provided having the steps of biasing a biasing member against a paper guide, passing a piece of paper between the biasing member and the paper guide such that the piece of paper is taut to a location further along a paper path and locating a printing device proximate to the biasing member and the paper guide to allow an image to be formed along a trailing edge of the paper.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions.

DETAILED DESCRIPTION OF THE INVENTION

The present invention is directed toward trailing edge deletion prevention, minimizing a portion along the trailing edge of the paper which cannot be imprinted due to the structure of the image forming system.

The term "image forming system" includes a collection of different printing technologies, such as electrophotographic, electrostatic, electrostatographic, ionographic, acoustic, piezo, thermal, laser, ink jet, and other types of image forming or reproducing systems adapted to capture and/or store image data associated with a particular object, such as a document, and reproduce, form, or produce an image. An example of an image forming system can be found in U.S. Pat. No. 5,583,629 to Brewington et al., the contents of which are herein incorporated by reference. As used herein, the term "paper" is intended to include a wide variety of imprintable media.

Figure 1:
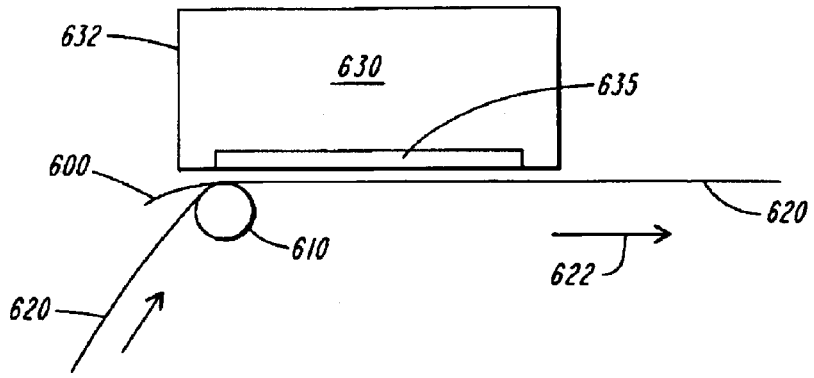
FIG. 1 is a side view of an embodiment of the present invention having a biasing member.

According to a first embodiment of the invention, FIG. 1 provides an illustration of a biasing member 600 in communication with a paper guide 610 so as to provide the ability to hold a piece of paper 620 on a paper path firmly to the paper guide 610, allowing the head carriage 630 to come in communication with the paper 620 near a trailing edge of the paper 620. The biasing member 600 is biased against the paper guide 610, preferably asserting a force against the paper guide 610 so as to keep the paper taut to a location further along the paper path. By keeping the paper taut, an image can be properly formed on the paper by a printing device. Preferably, biasing member 600 is a pinch spring, but may also be a leaf spring or other spring or elastic member. The biasing member 600 is preferably securely mounted to an image forming system frame at an end opposite the end of the biasing member 600 in communication with the paper guide 610. Alternatively, biasing member 600 may be mounted at any of one or more locations along biasing member 600 such that a portion of biasing member 600 is biased against the paper guide 610. The paper guide 610 functions to guide the paper within the image forming system. Preferably, the paper guide 610 is a roller, but may also be a device formed to guide the paper, such as a metal or plastic component formed to allow the paper to slide along the device.

The present invention allows a printing device to be moved over a piece of paper 620 while allowing an edge 632 of the printing device 630 to extend beyond the paper guide 610. Therefore, a printing area 635 of printing device 630 can be located over the position where the biasing member 600 meets the paper guide 610. Because the biasing member 600 and paper guide 610 are able to hold a trailing edge of the paper 620, the printing device 630 can imprint the paper 620 very close to the trailing edge of the paper 620. The paper 620 travels in a direction indicated by the arrow 622.

Figure 2:
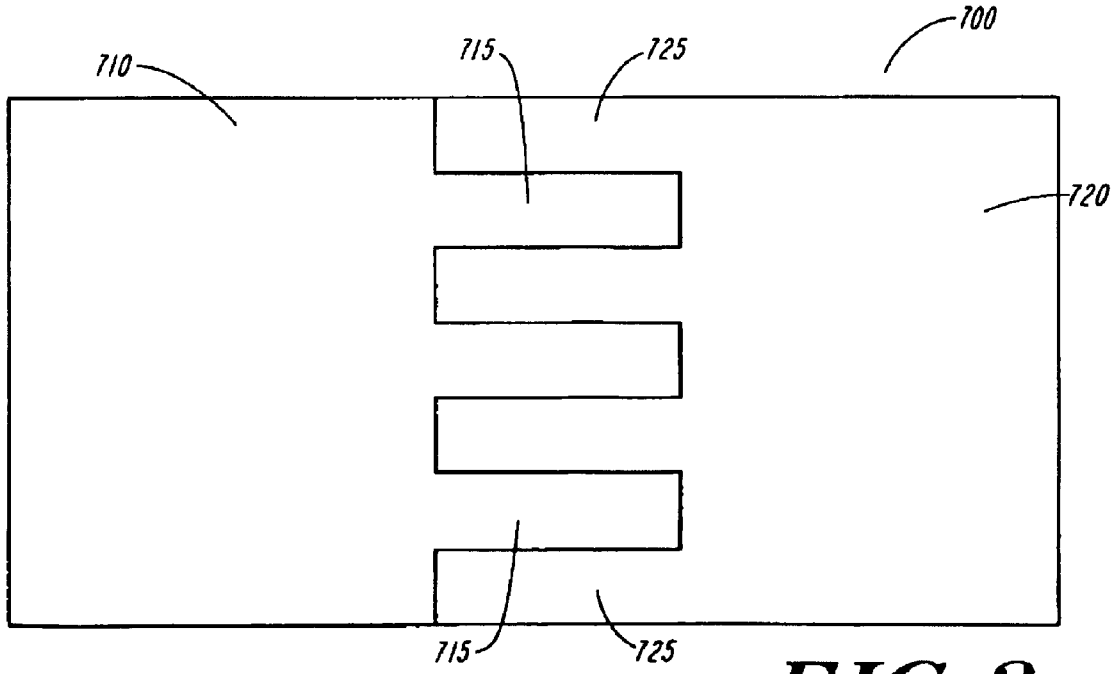
FIG. 2 is a side view of a further embodiment of the present invention having an interdigitated support element.

According to a further embodiment of the invention directed toward trailing edge deletion prevention, as shown in FIG. 2, an interdigitated support element 700 is provided. The interdigitated support element 700 functions to provide two independently movable portions that each can selectively enhance its grip on a piece of paper to allow the independently movable portions to move the piece of paper. Examples of interdigitated support elements include an interdigitated table. The interdigitated support element 700 may be operated by the use of electrostatic energy or a vacuum. As shown in FIG. 2, the interdigitated support element 700 has a first portion 710 having a plurality of first digits 715. A second portion 720 is also provided having a plurality of second digits 725 located along and opposite to the first digits 715.

In order to advance a piece of paper, one portion of the interdigitated support element, for example, a first portion 710 is activated so as to secure the paper. While the other portion, such as for example the second portion 720 is not activated, allowing the paper to remain free of the second portion 720. Then the first portion 710 is advanced away from the second portion 720. Next, the second portion 720 is activated to secure the paper, while the first portion 710 is deactivated, thereby releasing the paper. Then the first portion 710 is able to return back to its original position proximate to the second portion 720. Therefore, the paper has been advanced in the direction of the first portion 710.

It is also within the scope of the invention to advance the paper in an opposite direction by reversing the order of activation and deactivation of the portions described above. In another variation of the invention, the interdigitated support element 700 may be provided with a greater or lesser number of first digits 715 and/or second digits 725. The number of first digits 715 and the number of second digits 725 may be equal or unequal.

These examples are meant to be illustrative and not limiting. The present invention has been described by way of example, and modifications and variations of the exemplary embodiments will suggest themselves to skilled artisans in this field without departing from the spirit of the invention. Features and characteristics of the above-described embodiments may be used in combination. The preferred embodiments are merely illustrative and should not be considered restrictive in any way. The scope of the invention is to be measured by the appended claims, rather than the preceding description, and all variations and equivalents that fall within the range of the claims are intended to be embraced therein.

Having described the invention, what is claimed as new and protected by Letters Patent is:

1. A trailing edge deletion prevention apparatus in a thermal printer system, comprising:

a paper guide mounted along a paper path; and a biasing member mounted to said printer on an upstream side of the paper guide and biased against said paper guide along said paper path, wherein a piece of paper is passed between said biasing member and said paper guide to be taut to a location further along the paper path and a printing head is moved over said paper while allowing an edge of said printing head to extend beyond said paper guide to a position on the upstream side of the paper guide and to print along a trailing edge of said paper, wherein the upstream side of the paper guide is in a direction opposite the direction of travel of the paper in the paper path.

2. The trailing edge deletion prevention apparatus of claim 1, wherein said paper guide is a roller and is mounted perpendicular to said paper path and adapted to be rotatably mounted about an axis perpendicular to said paper path.

3. The trailing edge deletion prevention apparatus of claim 1, wherein said biasing member is a pinch spring.

4. The trailing edge deletion prevention apparatus of claim 3, wherein said biasing member has a first end adapted to be mounted to said image forming system and a second end biased against said paper guide such that said biasing member is substantially aligned, from said first end to said second end, toward said paper path.

5. The trailing edge deletion prevention apparatus of claim 1 further including:

a paper guide/biasing member position wherein the paper guide and biasing member meet.

6. The trailing edge deletion prevention apparatus of claim 5, wherein the printing device includes a printing area substantially located over the paper guide/biasing member position.

7. The apparatus according to claim 1, wherein the printing area extends to at least a central axis of the printing guide.

8. A method for preventing deleting a trailing edge of a piece of paper processed by a thermal printing system, comprising the steps of:

biasing a biasing member against a paper guide on an upstream side of the paper guide;

passing a piece of paper between said biasing member and said paper guide such that said piece of paper is taut to a location further along a paper path; and moving a printing device over said piece of paper while allowing an edge of said printing device to extend beyond said paper guide to a position on the upstream side of the paper guide, to allow an image to be formed along a trailing edge of said paper, wherein the upstream side of the paper guide is in a direction opposite the direction of travel of the paper in the paper path.

9. The method according to claim 8, wherein said moving step includes:

locating the printing device over a position where said biasing member and said paper guide meet.

10. The method according to claim 8, wherein the printing area extends to at least a central axis of the printing guide.

11. A trailing edge deletion prevention apparatus in a thermal printing system, comprising:

a movable printing device having at least a first edge, and a printing area;

a paper guide mounted along a paper path and adapted to guide paper along said paper path; and a biasing member mounted to said printing system on an upstream side of the paper guide and biased against said paper guide to cause said paper to be taut to a location further along said paper path and configured to accommodate the movable printing device to move over a piece of paper wherein the first edge of said printing device extends beyond said paper guide to a position on the upstream side of the paper guide to allow an image to be formed along a trailing edge of said paper, and wherein the printing area of the printing device is substantially located over a position where the biasing member and the paper guide meet.

12. The trailing edge detection prevention apparatus of claim 11, wherein said paper guide is a roller and is mounted perpendicular to said paper path and adapted to be rotatably mounted about an axis perpendicular to said paper path.

13. The trailing edge detection prevention apparatus of claim 11, wherein said biasing member is a pinch spring.

14. The trailing edge deletion prevention apparatus of claim 13, wherein said biasing member has a first end adapted to be mounted to said image forming system and a second end biased against said paper guide such that said biasing member is substantially aligned, from said first end to said second end, toward said paper path.

15. The apparatus according to claim 11, wherein the upstream side of the paper guide is in a direction opposite the direction of travel of the paper in the paper path.

16. The apparatus according to claim 11, wherein the printing area extends to at least a central axis of the printing guide.

* * * * *